US006362572B1

(12) United States Patent
Hepburn

(10) Patent No.: US 6,362,572 B1
(45) Date of Patent: Mar. 26, 2002

(54) DECORATIVE LAMP ASSEMBLY HAVING A TRANSPARENT ENVELOPE CONTAINING INERT GAS MIXTURES

(76) Inventor: Mundy M. Hepburn, 16 Cedarwood La., Old Saybrook, CT (US) 06475

( * ) Notice: Subject to any disclaimer, the term of this patent is extended or adjusted under 35 U.S.C. 154(b) by 0 days.

(21) Appl. No.: 09/338,043

(22) Filed: Jun. 22, 1999

(51) Int. Cl.[7] ..... H01J 17/20; H01J 61/12

(52) U.S. Cl. ..... 313/637; 313/643; 313/573; 313/485

(58) Field of Search ..... 313/637, 643, 313/608, 485, 635, 568, 572, 573

(56) References Cited

U.S. PATENT DOCUMENTS 2,491,854 A * 12/1949 Force ..... 313/594
4,379,253 A * 4/1983 Myer ..... 315/289
5,309,069 A * 5/1994 Sigai et al. ..... 313/486

* cited by examiner

*Primary Examiner*—Nimeshkumar D. Patel
*Assistant Examiner*—Kevin Quarterman
(74) *Attorney, Agent, or Firm*—William W. Jones

(57) ABSTRACT

A decorative lamp includes a glass envelope that contains mixtures of inert gases which produce various visual effects when exposed an electric charge. The glass envelope is evacuated to sub-atmospheric pressures; is infused with a desired inert gas mixture, and is sealed. Appropriate electrical contacts are applied to the sealed envelope and the envelope assembly is connected to a source of electric current. The various light effects that can be achieved include meandering arcs of light that rise through the envelope; tiny fire fly-type light effects that rise through the envelope; and a central tree and leaf-type light display that undulates upwardly through the lamp envelope, among others. The light effects can be enhanced by the application of a phosphor coating to the interior of the envelope. The light effects can also be selectively colored by adding an inorganic fluorescent colorant, or a mixture of inorganic fluorescent colorants to the interior of the envelope.

16 Claims, 4 Drawing Sheets

DECORATIVE LAMP ASSEMBLY HAVING A TRANSPARENT ENVELOPE CONTAINING INERT GAS MIXTURES

TECHNICAL FIELD

This invention relates to a decorative lamp assembly which provides unique electronically-generated light displays.

BACKGROUND ART

Devices which display electronically-generated light phenomena are well known. Early light phenomena-developing lamps were developed along with the development of continuous sources of high potentials. Nikola Tesla demonstrated the ability to produce light effects from gas discharges in various gas filled vessels through the use of induce electrical currents generated in the vessels. Neon and fluorescent lights are commercial products which utilize the aforesaid electronically generated light effects produced in a gaseous medium.

The aforesaid discoveries have resulted in the production of various forms of decorative lamps such as the "EYE OF THE STORM", and others. One, William P. Parker, has obtained a number of U.S. patents that describe various aspects of such decorative lamps. The effects that are created in the lamps are largely the result of the gas mixtures and the pressure inside of the lamp vessels which contain the gas mixtures.

I have discovered that certain inert gas mixtures, when incorporated in a lamp vessel or envelope at certain pressures, can produce new visual effects when stimulated by an electrical current source of the sort described in the prior art.

DISCLOSURE OF THE INVENTION

This invention relates to a decorative lamp assembly which contains novel mixtures of gases that serve to produce different visual phenomena when subjected to electrical currents. The lamp assemblies include a base which houses the electrical components of the lamp, and a glass envelope which contains the gas mixtures and other components of the lamps. The glass envelope can be formed in a number of different configurations which are chosen to enhance the visual light effects which occur inside of the envelope. With one gas mixture that produces a wandering arc light effect, the envelopes are preferably formed in a curlicue configuration so that the arc will follow a spiral or curlicue path in the envelope. With another gas mixture that creates a branched and leafy, or firefly-appearing visual light effect, I prefer to utilize an envelope configuration which has a natural appearance, and is preferably shaped like a mushroom or a jelly fish.

It is therefore an object of this invention to provide a decorative lamp assembly which includes a transparent envelope that contains a mixture of gases which when subjected to an electrical current will create different visual effects that are visible through the envelope.

It is a further object of this invention to provide a decorative lamp assembly of the character described wherein the visual effects are moving effects in the envelope.

It is another object of this invention to provide a decorative lamp assembly of the character described wherein the visual effects comprise a wandering arc of light.

It is yet another object of this invention to provide a decorative lamp assembly of the character described wherein the visual effects comprise a branched core of light with terminal leaves or fire fly-like effects.

BRIEF DESCRIPTION OF THE DRAWINGS

These and other objects and advantages of this invention will become readily apparent to one skilled in the art from the following detailed description of preferred embodiments of the invention when taken in conjunction with the accompanying drawings in which.

SPECIFIC MODES FOR CARRYING OUT THE INVENTION

Figure 1:
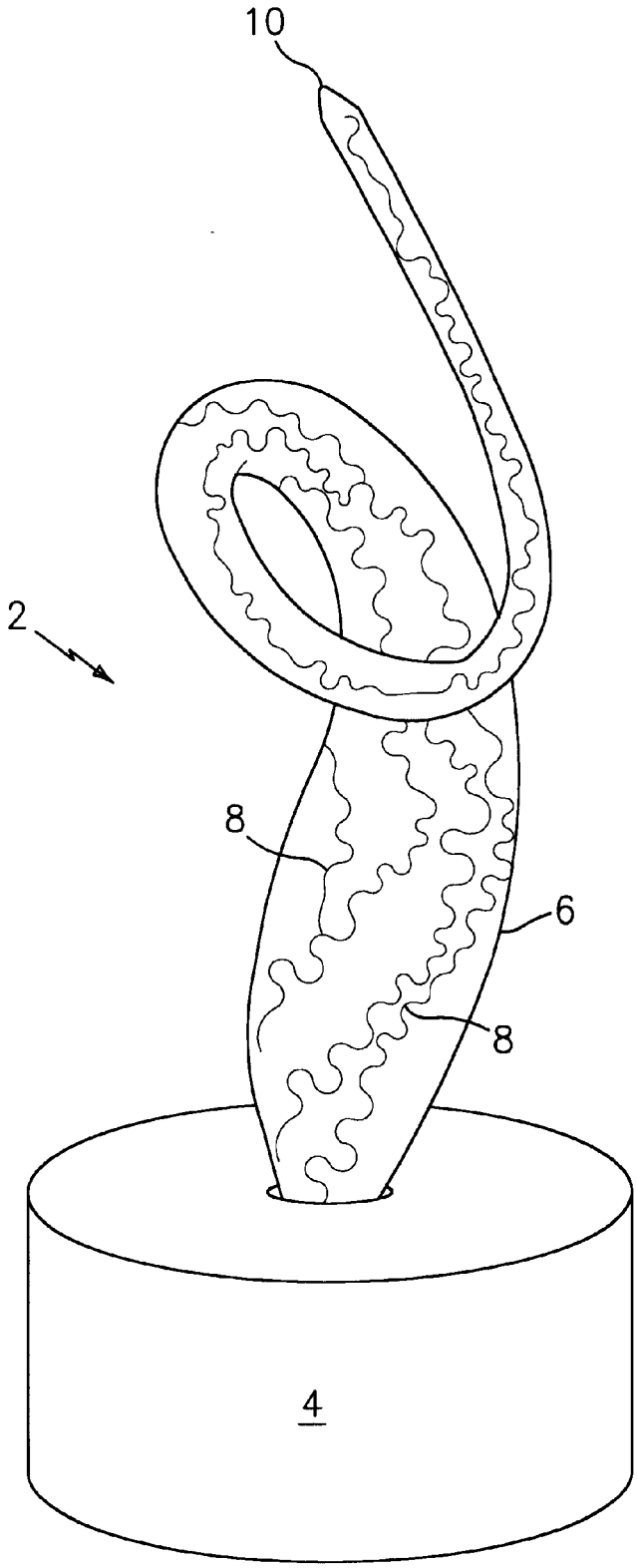
FIGS. 1–5 are perspective views of various embodiments of a decorative lamp assembly which is formed in accordance with this invention and which have variations of a curlicue light-display envelope and a curlicue wandering light arc display inside of the envelope.
Figure 2:
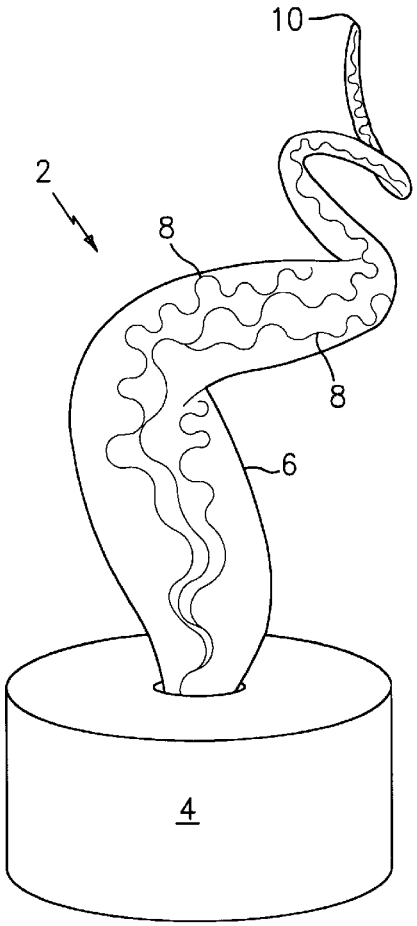
Figure 3:
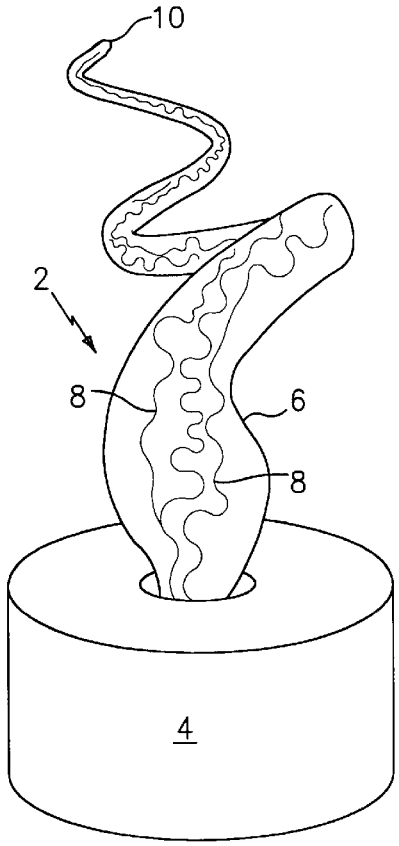

Referring now to the drawings, there are shown in FIGS. 1–5 perspective views of decorative lamps denoted generally by the numeral 2, and the light effects produced in the lamps 2, which lamps 2 are formed in accordance with this invention. The lamps 2 include a base 4 and a glass envelope 6. The envelope 6 in each case is generally curlicue-shaped. The light effects in the lamps 2 take the form of an arc 8 which is also generally curlicue in path. The arc or arcs 8 exists in the envelope 6 and extends from the base 4 to the upper end 10 of the envelope 6. The arc or arcs 8 then will spin or rotate inside of the envelope 6 to create the moving light display. The various meandering lines in the drawings are illustrative of the rotational movement of the arcs 8 within the envelope 6. The meandering arc 8 is achieved by filling the lamp envelope 6 with a mixture of several gases in certain percentages, and by evacuating the envelope 6 to a certain pressure. The gas mixture needed to produce the meandering arc 8 is as follows: Xenon in the range of about 50% to about 85%; Krypton in the range of about 10% to about 40%; Argon in the range of about 5% to about 20%; and a trace of Oxygen. The pressure in the envelope 6 is in the range of about 20 to about 700 Torr. The preferred gas mixture for achieving the meandering arc effect is 50% Xenon; 35% Krypton; 15% Argon; and the trace of Oxygen. The preferred envelope pressure is 100 Torr. It should be noted that the trace of Oxygen is acquired when the glass envelope 6 is sealed during assembly of the lamps.

In order to enhance the brightness and colors of the light effects, the interior of the envelope 6 can be provided with a coating of phosphor. The phosphor coating is applied as follows. The interior of the envelope 6 is dusted with a mixture of about one gram of zinc silicate green and about two hundred grams of clean beach sand, or 80 mesh natural glass sand, and phosphor. The aforesaid mixture is poured into the lamp envelope 6 before the electrode is fused to the envelope 6. The lamp envelope 6 is then shaken so as to evenly distribute the mixture onto the inside surface of the envelope 6 and to form a monolayer of tiny phosphor crystals on the inside surface of the envelope. The aforesaid application of the phosphor layer to the Inside of the glass envelope 6 produces a slightly cloudy surface on the envelope 6. The aforesaid coating procedure can be performed with materials that will produce more than one color in the envelope 6 thereby producing a more complex visual effect. A static electrical surface charge on the interior of the envelope 6, which is natural to the glass, will act to bond the phosphor crystals firmly to the inner surface of the envelope 6. No auxiliary binder is necessary. Other inorganic fluorescent colorant materials, such as yttrium oxide red, and/or strontium chlorapatite blue, could also be used in place of, or in combination with the zinc silicate green. By appropriately mixing the red, blue, and green colorant materials, a broad spectrum of color effects can be achieved.

Figure 6:
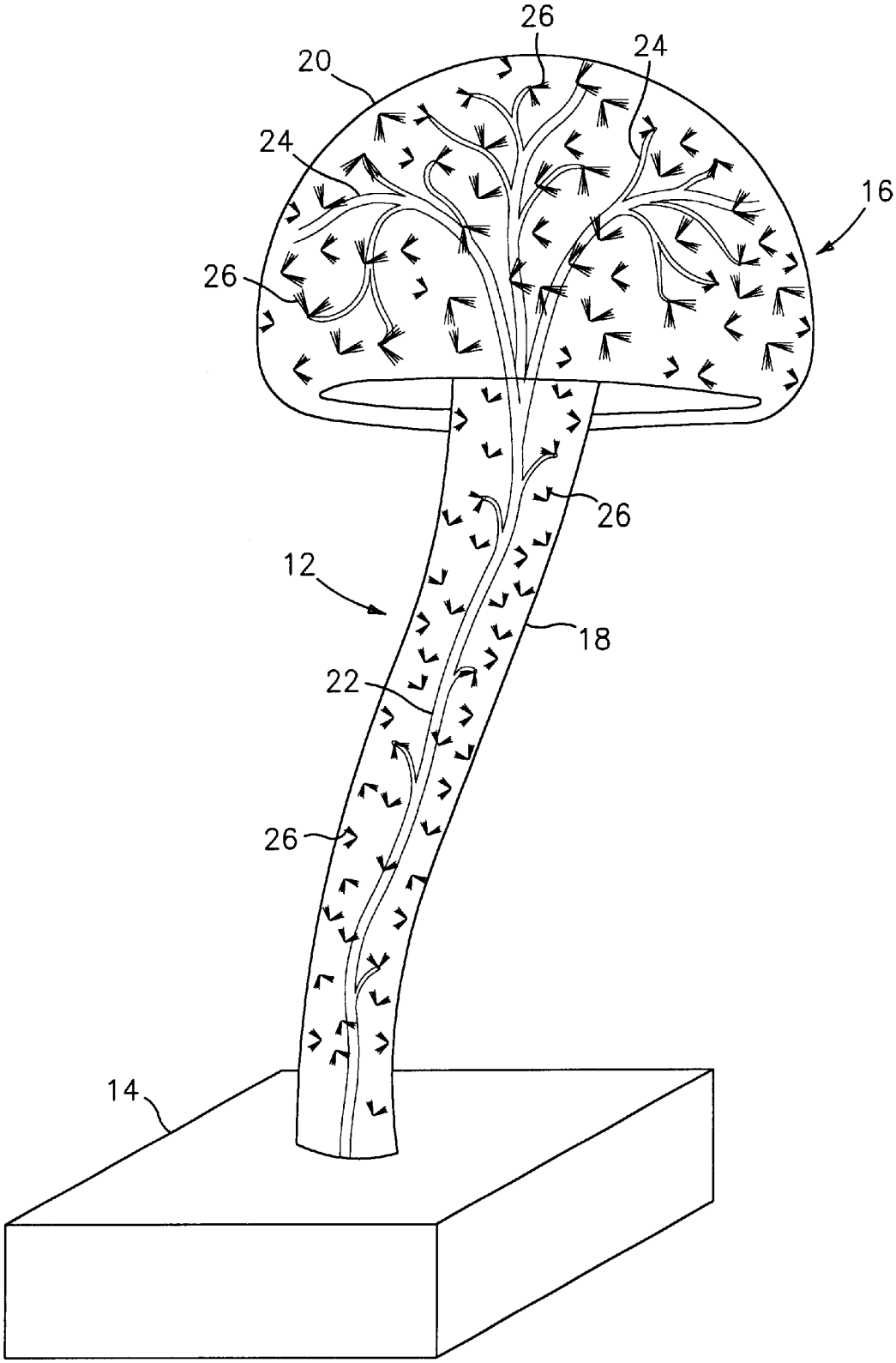
FIG. 6 is a perspective view of a different embodiment of a lamp envelope that is essentially mushroom-shaped, and that provides a branched fire fly or leafy light display.

Referring now to FIG. 6, there is shown another embodiment of a decorative lamp assembly which is formed in accordance with this invention. The lamp assembly shown in FIG. 6 is denoted generally by the numeral 12, and includes a base 14 and an envelope that is denoted generally by the numeral 16. The envelope 16 has a generally mushroom-shaped configuration, with a stem 18 and head 20. The light display generated in the lamp envelope 16 includes a trunk 22 that is created in the stem 18 of the envelope 16, and also includes branches 24 that are created in the head 20 of the envelope 16. The trunk 22 of light and the branches 24 pulsate inside of the envelope 16. A plurality of fire flies or leaves 26 are created in the light display, which flutter around the trunk 22 and the branches 24 the light display when the lamp 12 is turned on. The gas mixture needed to produce the effect shown in FIG. 6 is as follows: Nitrogen in the range of about 0.001% to about 2.0%; Xenon in the range of about 1.0% to about 6.0%; Krypton in the range of about 20% to about 30%; Argon in the range of about 5% to about 15%; Neon in the range of about 50% to about 70%; Helium in the range of about 5.0% to about 9.0%; and a trace of Oxygen. The pressure in the envelope 16 is in the range of about 200 to about 250 Torr. The preferred gas mixture for achieving the "fire fly" effect is 1.0% Nitrogen; 2.0% Xenon; 28% Krypton; 10% Argon; 50% Neon; 9.0% Helium; and the trace of Oxygen. The preferred envelope pressure is 225 Torr. It should be noted that the trace of Oxygen is acquired when the glass envelope 16 is sealed during assembly of the lamps.

Figure 7:
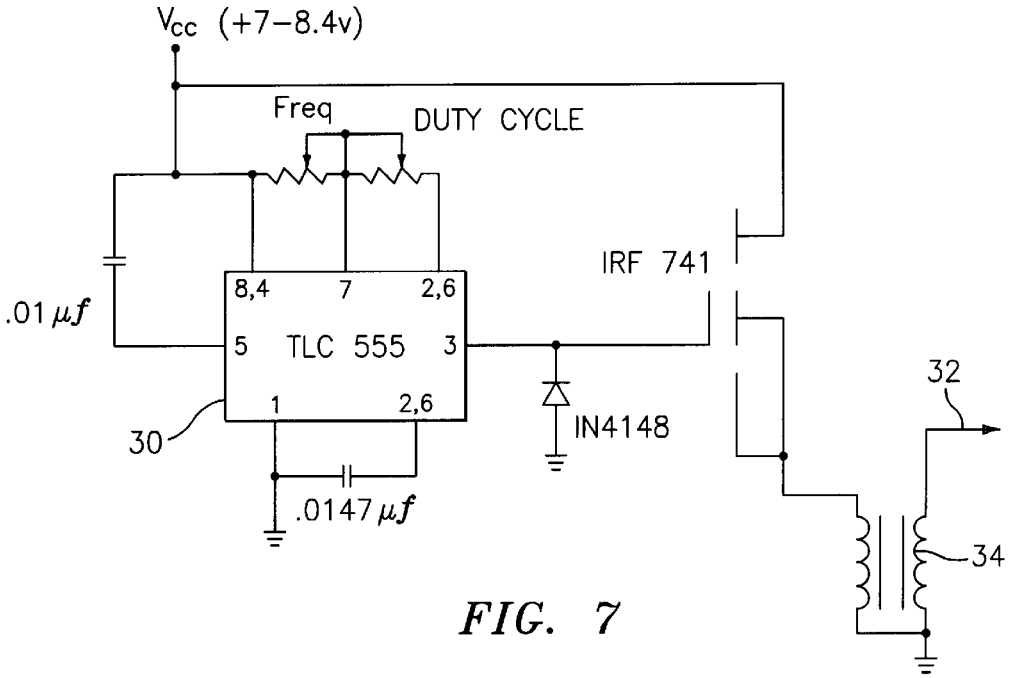
FIG. 7 is a schematic view of an electrical power circuit which can be employed in the lamps shown in the prior figures to assist in production of the desired light effects.
Figure 4:
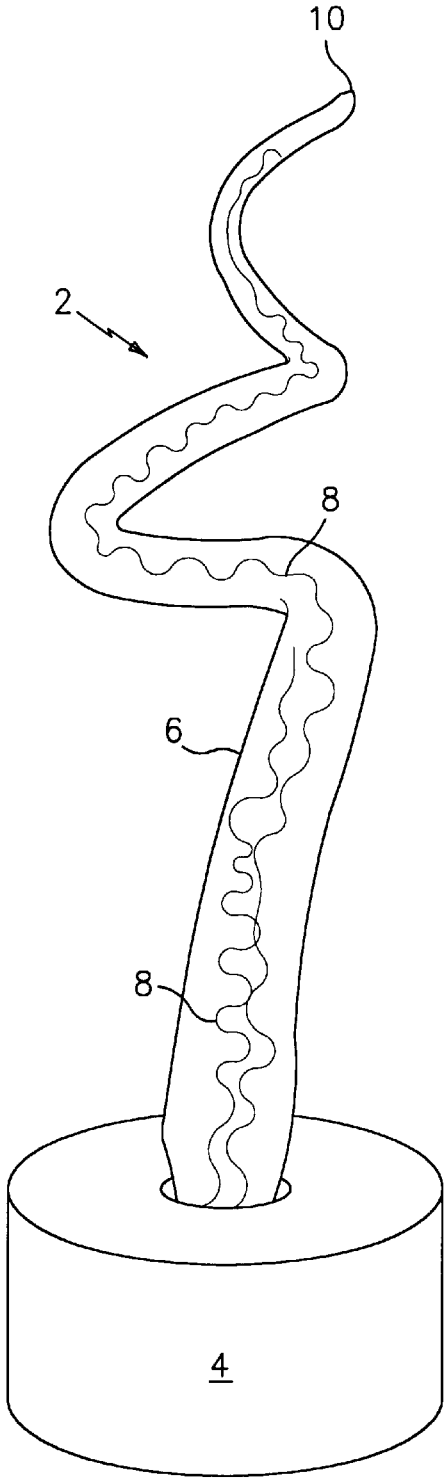
Figure 5:
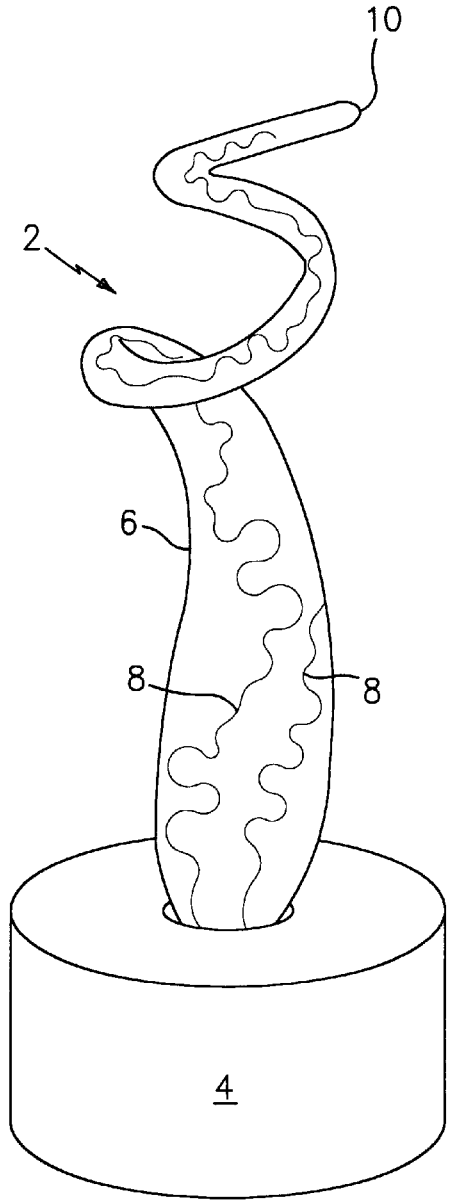

Referring now to FIG. 7, there is shown a schematic drawing of a waveform generating circuit that is contained in the base 4 of the lamps. The circuit includes a COSMOS type TLC 555 integrated circuit 30 followed by an FET output amplifier and a resonant core high voltage transformer 34. The circuit configuration is adjustable in the frequency range 5,000 to 80,000 Hertz, and has maximum peak-to-peak output voltage of 4,000 volts at lead 32 with a power consumption of 15 watts derived from a 12 volt DC wall adapter 36. In various embodiments, the waveform generating network may provide a time varying signal, for example, sine wave or square wave, periodic or otherwise, and may also include various modulation, filtering or other signal modifying networks.

It will be readily appreciated that the gas mixtures, colorants, and operating pressures of the lamps of this invention will provide moving visual light effects that can be enhanced by the configurations of the lamp envelopes. The lamps are unusual in shape, and the visual light effects inside of the lamp envelopes are quite unique, when compared to other novelty or decorative lamps, such as lava lamps, or the like.

Since many changes and variations of the disclosed embodiments of the invention may be made without departing from the inventive concept, it is not intended to limit the invention other than as required by the appended claims.

What is claimed is:

1. A decorative lamp assembly comprising:

a) a sealed glass envelope;

b) a mixture of gases in said envelope, said mixture consisting essentially of Xenon in the range of about 50% to about 85%, Krypton in the range of about 10% to about 40%; Argon in the range of about 10% to about 40%, and trace amounts of Oxygen; and c) an electrical network for delivering a voltage to said gases in said envelope which voltage is sufficient to create a bright moving arc light display In said envelope.

2. The decorative lamp assembly of claim 1 wherein said envelope has an interior phosphor coating that enhances the brightness of said moving arc light display in said envelope.

3. The decorative lamp assembly of claim 1 wherein said envelope is curlicue in configuration.

4. The decorative lamp assembly of claim 1 wherein said gas mixture consists essentially of 50% Xenon, 35% Krypton, 15% Argon, and trace amounts of Oxygen.

5. The decorative lamp assembly of claim 1 wherein said envelope has an internal pressure which is in the range of about 20 to about 700 Torr.

6. The decorative lamp assembly of claim 1 wherein said envelope has an internal pressure of about 100 Torr.

7. The decorative lamp assembly of claim 1 wherein said envelope has an interior inorganic fluorescent material coating colorant that selectively colors the moving arc light display in said envelope.

8. The decorative lamp assembly of claim 7 wherein said inorganic fluorescent material is a compound selected from the group consisting of: zinc silicate green; yttrium oxide red; strontium chlorapatite blue; and mixtures thereof.

9. A decorative lamp assembly comprising:

a) a sealed glass envelope;

b) a mixture of gases in said envelope, said mixture consisting essentially of Nitrogen in the range of about 0.001% to about 2.0%, Xenon in the range of about 1.0% to about 6.0%, Krypton in the range of about 20% to about 30%; Argon in the range of about 5.0% to about 15%, Neon in the range of about 50% to about 70%, Helium in the range of about 5.0% to about 9.0%, and trace amounts of Oxygen; and c) an electrical network for delivering a voltage to said gases in said envelope which voltage is sufficient to create a bright moving branched light display in said envelope.

10. The decorative lamp assembly of claim 9 wherein said envelope has an interior phosphor coating that enhances the brightness of said moving branched light display in said envelope.

11. The decorative lamp assembly of claim 9 wherein said envelope has an interior inorganic fluorescent material colorant coating that selectively colors the moving light display in said envelope.

12. The decorative lamp assembly of claim 11 wherein said inorganic fluorescent material is a compound selected from the group consisting of: zinc silicate green; yttrium oxide red; strontium chlorapatite blue; and mixtures thereof.

13. The decorative lamp assembly of claim 9 wherein said envelope is mushroom shaped in configuration.

14. The decorative lamp assembly of claim 9 wherein said gas mixture consists essentially of 1.0% Nitrogen, 2.0% Xenon, 28% Krypton, 10% Argon, 50% Neon, 9.0% Helium, and trace amounts of Oxygen.

15. The decorative lamp assembly of claim 9 wherein said envelope has an internal pressure which is in the range of about 200 to about 250 Torr.

16. The decorative lamp assembly of claim 9 wherein said envelope has an internal pressure of about 225 Torr.

* * * * *